US009144986B2

(12) United States Patent
Kanaya et al.

(10) Patent No.: US 9,144,986 B2
(45) Date of Patent: Sep. 29, 2015

(54) RECORDING APPARATUS

(71) Applicant: SEIKO EPSON CORPORATION, Tokyo (JP)

(72) Inventors: Munehide Kanaya, Azumino (JP); Shoma Kudo, Shiojiri (JP); Hidenao Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/533,781

(22) Filed: Nov. 5, 2014

(65) Prior Publication Data

US 2015/0138283 A1 May 21, 2015

(30) Foreign Application Priority Data

Nov. 15, 2013 (JP) ..... 2013-236601

(51) Int. Cl.
*B41J 2/175* (2006.01)

(52) U.S. Cl.
CPC ..... *B41J 2/175* (2013.01)

(58) Field of Classification Search
CPC ..... B41J 2/175; B41J 2/17509
USPC ..... 347/85
See application file for complete search history.

(56) References Cited

U.S. PATENT DOCUMENTS

| | | | | |
|---|---|---|---|---|
| 6,378,997 | B1 * | 4/2002 | Nitta | 347/85 |
| 7,034,865 | B2 * | 4/2006 | Tojo et al. | 348/207.2 |
| 2005/0088493 | A1 | 4/2005 | Koga | |
| 2005/0231567 | A1 | 10/2005 | Koga | |
| 2011/0316946 | A1 * | 12/2011 | King et al. | 347/86 |

FOREIGN PATENT DOCUMENTS

| | | |
|---|---|---|
| CN | 2825289 | 10/2006 |

* cited by examiner

*Primary Examiner* — Alessandro Amari
*Assistant Examiner* — Michael Konczal
(74) *Attorney, Agent, or Firm* — Workman Nydegger

(57) ABSTRACT

There is provided a recording apparatus including: a printer main body which has a liquid ejecting head that ejects ink to a paper sheet and performs recording; a supply cassette which is insertable into and extractable from the printer main body and can accommodate the paper sheet; and a liquid accommodation portion which can accommodate the ink that is supplied to the liquid ejecting head. The liquid accommodation portion is installed in the supply cassette.

15 Claims, 12 Drawing Sheets

RECORDING APPARATUS

BACKGROUND

1. Technical Field

The present invention relates to a recording apparatus which performs recording by ejecting liquid to a target.

2. Related Art

In the related art, an ink jet type printer, which performs recording (printing) by ejecting ink as an example of liquid to a target, such as a paper sheet, from a liquid ejecting head, is known as a type of a recording apparatus. In such a printer, when performing a relatively large amount of printing, it is required that the ink be continuously and reliably supplied to the liquid ejecting head. For this reason, a configuration, in which the ink is supplied to the liquid ejecting head through an ink supply tube from an ink tank (liquid accommodation portion) that has a relatively large accommodation capacity of the ink, has been suggested (for example, refer to Chinese Registered Utility Model No. CN2825289Y).

In the printer having this configuration, the ink tank is disposed not to disturb an operation of the printer. For example, the ink tank is not installed on a side of a discharging direction of the paper sheet, or on a front surface side of a printer main body which is a side where an operation for inserting and extracting a supply cassette (paper sheet cassette) that can accommodate the paper sheet supplied to the liquid ejecting head is performed. In general, the ink tank is installed on a lateral side of the printer main body which is a side in a right-and-left direction when viewed from a front surface side. Otherwise, the ink tank is installed on a rear side of the printer main body which is a side in a direction opposite to the front surface side. For this reason, a necessary installation area for installing the ink tank becomes large in addition to the printer main body. For example, when the ink tank is installed on the lateral side of the printer main body, since the installation area is large in a lateral direction, there is a problem in that an installation location is restricted.

In addition, there is also a case where the ink tank is positioned at a location which is apart from the front surface side of the printer main body and which is a position where a user gets easy access for collecting the paper sheet discharged from the printer main body, or the like. Therefore, for example, when an operator pours the ink into the ink tank and fills the ink tank with the ink, as the operator moves the ink tank to the front surface side from the lateral side of the printer main body, easy access to the ink tank is required. At this time, when the ink tank is attached to the printer main body, a bothersome operation which is called detaching the ink tank from the printer main body is required. In addition, when the ink tank is detached, the ink tank requires an operation according to a load, such as making the printer main body move so that the ink tank is moved to the front surface side.

In addition, this circumstance is mostly the same not only in the printer, but also in a recording apparatus including: an apparatus main body which has the liquid ejecting head that ejects the liquid to the target and performs the recording; a supply cassette which is insertable into and extractable from the apparatus main body and can accommodate the target; and a liquid accommodation portion which can accommodate the liquid that is supplied to the liquid ejecting head.

SUMMARY

An advantage of some aspects of the invention is to provide a recording apparatus which can easily make a liquid accommodation portion filled with liquid for recording while suppressing an increase in an installation area.

Hereinafter, means of the invention and operation effects thereof will be described.

According to an aspect of the invention, there is provided a recording apparatus which solves the above-described problem, including: an apparatus main body which has a liquid ejecting head that ejects liquid to a target and performs recording; a supply cassette which is insertable into and extractable from the apparatus main body and can accommodate the target; and a liquid accommodation portion which can accommodate the liquid that is supplied to the liquid ejecting head. The liquid accommodation portion is installed in the supply cassette.

In this configuration, it is possible to move at least a part of the liquid accommodation portion to the outside of the apparatus main body by extracting the supply cassette. Therefore, when getting access to the liquid accommodation portion, without moving the recording apparatus, an operator can access the liquid accommodation portion from an extraction side of the supply cassette which can easily make the liquid accommodation portion filled with the liquid for recording and can easily make the liquid accommodation portion filled with the liquid for recording. In addition, since the liquid accommodation portion is provided to be overlapped with the supply cassette in the apparatus main body when viewed from a vertical direction, an increase in an installation area of a printer 11 is suppressed even when a liquid accommodation portion has a relatively large accommodation capacity of the ink.

According to the aspect, it is preferable that the supply cassette be provided with a partitioning member which partitions an accommodation area for accommodating the target in a stacked state and an installation area of the liquid accommodation portion.

In this configuration, by the partitioning member, it is possible to accommodate and install the target and the liquid accommodation portion in a state where the target and the liquid accommodation portion do not interrupt each other in the supply cassette.

According to the aspect, it is preferable that the partitioning member partition the accommodation area and the installation area so that the accommodation area and the installation area are not overlapped with each other when viewed from a stacking direction of the target.

In this configuration, it is possible to easily enlarge the accommodation area of the target and the installation area of the liquid accommodation portion while keeping a state where the accommodation area and the installation area do not interrupt each other in the supply cassette.

According to the aspect, it is preferable that the partitioning member partition the accommodation area and the installation area so that at least parts of the accommodation area and the installation area are overlapped with each other when viewed from the stacking direction of the target. It is preferable that, in a state where the supply cassette is inserted into the apparatus main body, the liquid accommodation portion which is installed in the supply cassette be positioned to be closer to an anti-gravity direction side in the stacking direction than the target which is accommodated in the supply cassette.

In this configuration, since it is possible to easily access the liquid accommodation portion in the supply cassette, it is possible to easily make the liquid accommodation portion filled with the liquid for recording.

According to the aspect, it is preferable that the partitioning member partition the accommodation area and the installation area so that at least parts of the accommodation area and the installation area are overlapped with each other when viewed from the stacking direction of the target. It is preferable that, in a state where the supply cassette is inserted into the apparatus main body, the liquid accommodation portion which is installed in the supply cassette be positioned to be closer to a gravity direction side in the stacking direction than the target which is accommodated in the supply cassette.

In this configuration, since the target in the supply cassette is positioned on the anti-gravity direction side of the liquid accommodation portion, a probability that the liquid moves to the target side is low. Therefore, contamination caused by the ink of the target accommodated in the supply cassette is suppressed.

According to the aspect, it is preferable that the partitioning member be provided to be movable in the supply cassette.

In this configuration, as the partitioning member is moved in the supply cassette, it is possible to appropriately change an occupancy ratio between the accommodation area and the installation area according to a capacity of the accommodated target or a capacity of the installed liquid accommodation portion.

According to the aspect, it is preferable that, in the installation area, a storage portion which stores the liquid accommodation portion be provided, and the storage portion be provided to be movable in the supply cassette.

In this configuration, it is possible to move at least a part of the liquid accommodation portion to the outside of the apparatus main body.

According to the aspect, it is preferable that the liquid accommodation portion be installed on an extracting direction side from the apparatus main body in the supply cassette.

In this configuration, it is possible to reliably move at least a part of the liquid accommodation portion to the outside of the apparatus main body.

According to the aspect, it is preferable that the apparatus main body include a first case which has the liquid ejecting head and a second case which is attachable to and detachable from the first case, and the supply cassette which has the liquid accommodation portion installed thereon can be inserted into and extracted from at least one of the first case and the second case.

In this configuration, when the recording apparatus is configured by a plurality of cases which are attachable to and detachable from each other, it is possible to provide the supply cassette in which the liquid accommodation portion is installed in any case. For example, when the attachable and detachable second case is provided in the first case, the supply cassette can include a liquid accommodation portion which can supply various amounts of liquid or various types of liquid with respect to the liquid ejecting head provided in the first case according to the mounted second case.

According to the aspect, it is preferable that the liquid accommodation portion be provided with a pouring port which can pour the liquid accommodated in the liquid accommodation portion.

In this configuration, as the operator pours the liquid into the liquid accommodation portion provided in the supply cassette from the pouring port, it is possible to easily make the liquid accommodation portion filled with the liquid.

According to the aspect, it is preferable that, in the apparatus main body, a liquid supply tube be provided which is connected to the liquid accommodation portion and supplies the liquid to the liquid ejecting head. It is preferable that the liquid supply tube be connected to an end portion on a side in a direction opposite to the extracting direction of the supply cassette in the liquid accommodation portion.

In this configuration, when getting access to the liquid accommodation portion, since the operator can access the liquid accommodation portion without being disturbed by the liquid supply tube from the extracting direction of the supply cassette, it is possible to easily make the liquid accommodation portion filled with the liquid.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, as an embodiment of a recording apparatus, an ink jet type printer, which is provided with a liquid ejecting head that ejects ink as an example of liquid for recording and which ejects the ink to a paper sheet as an example of a target and prints (records) an image including characters or figures, will be described with reference to the drawings.

Figure 1:
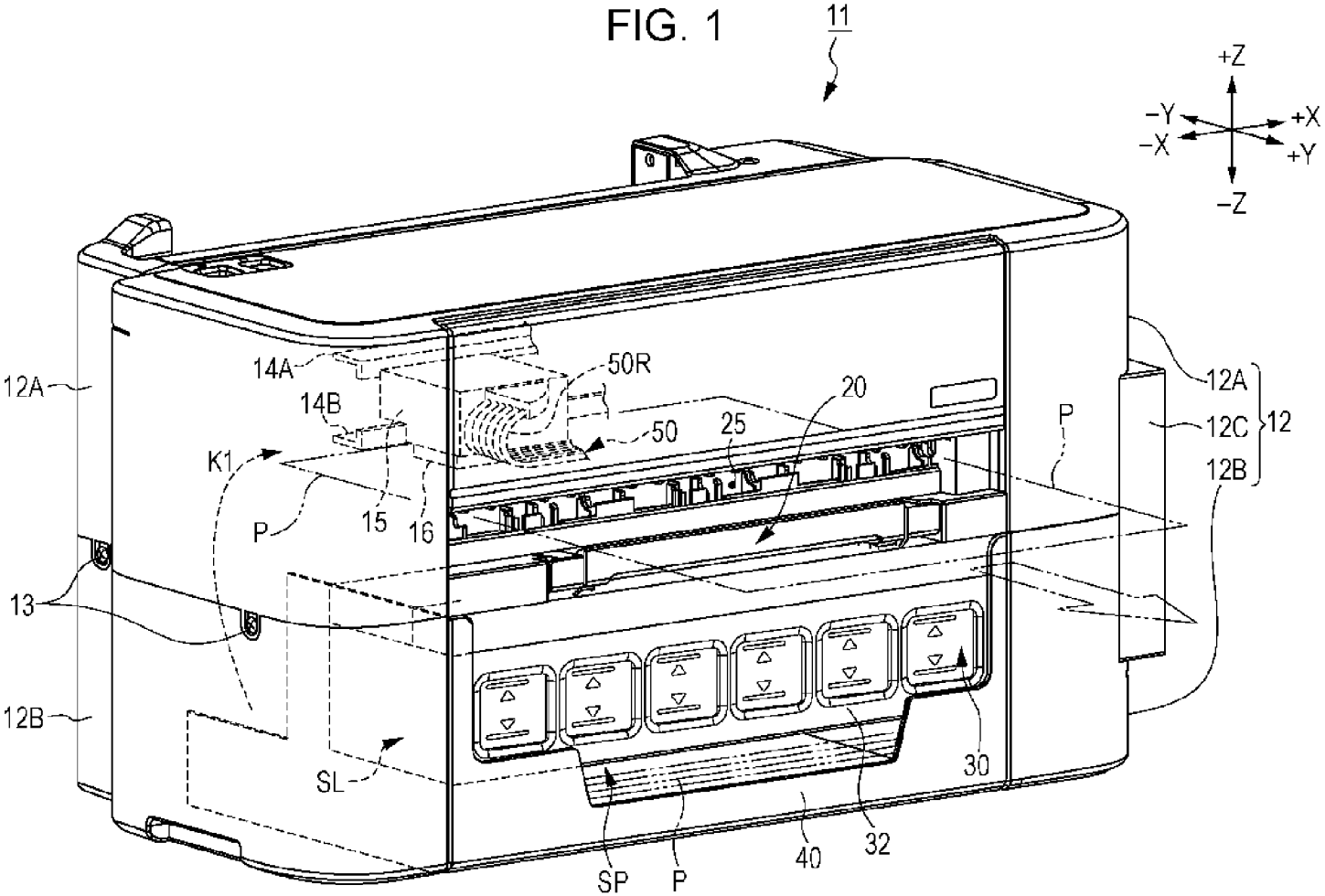
FIG. 1 is a perspective view illustrating a printer as an example of an embodiment of a recording apparatus.

As described in FIG. 1, a printer 11 as an example of the recording apparatus includes a printer main body 12 as an apparatus main body in a substantially rectangular parallelepiped shape which is configured to have: an upper side case 12A which is positioned on an anti-gravity direction (+Z direction) side in a vertical direction; a lower side case 12B which is positioned on a gravity direction (−Z direction) side; and a lid case 12C which is positioned across both cases 12A and 12B. In addition, each of cases 12A, 12B, and 12C is connected and fixed to the others by a screw 13 or the like. In the printer main body 12, the printer 11 is provided with a liquid ejecting head 16, a discharging portion 20 which discharges a paper sheet P, and a supply cassette 40 which can accommodate the paper sheet P that is supplied to the liquid ejecting head 16. The supply cassette 40 can be inserted into and extracted from the printer main body 12, and the supply cassette 40 is provided with a liquid accommodation portion 30 that can accommodate the ink that is supplied to the liquid ejecting head 16.

The liquid ejecting head 16 is positioned on an upper side which is the anti-gravity direction (+Z direction) side in the vertical direction with respect to the discharging portion 20, and ejects the ink to the paper sheet P which is transported to the lower side which is the gravity direction (−Z direction) side of the liquid ejecting head 16. In addition, the liquid ejecting head 16 is movable to a scanning direction (±X direction) which intersects with a transporting direction (+Y direction) of the paper sheet P. In other words, the liquid ejecting head 16 is supported by two guide rails 14A and 14B which extend in a scanning direction, and is attached to a carriage 15 which slides along the guide rails 14A and 14B. Therefore, as the carriage 15 is moved in the scanning direction by a driving mechanism (not illustrated), the liquid ejecting head 16 moves in the scanning direction (±X direction).

As appropriate ink is ejected to the paper sheet P which moves in the transporting direction from the liquid ejecting head 16 that moves in the scanning direction, printing is performed on the paper sheet P. In addition, in the embodiment, a discharging direction when the printed paper sheet P is discharged from the printer main body 12 is the same direction as the transporting direction of the paper sheet P (+Y direction), and the discharging direction side is a front side, that is, a front surface side of the printer main body 12.

In the carriage 15, a plurality of liquid supply tubes 50 for supplying the ink accommodated in the liquid accommodation portion 30 is connected to a front (+Y direction) side opposite to a rear side supported by the two guide rails 14A and 14B. Each liquid supply tube 50 has a deformable curved portion 50R, and supplies the ink from the liquid accommodation portion 30 to the carriage 15 via the curved portion 50R. The ink supplied to the carriage 15 is supplied to the liquid ejecting head 16 via an ink flow path (not illustrated) provided in the carriage 15. In addition, in the embodiment, six liquid supply tubes 50 are connected to the carriage 15 to be aligned in a front-and-rear direction.

In the printer 11 of the embodiment, the supply cassette 40 is provided on a lower side which is the gravity direction (−Z direction) side of the vertical direction with respect to the discharging portion 20. In the supply cassette 40, the liquid accommodation portion 30 is installed on the extracting direction side from the printer main body 12. In addition, as the supply cassette 40 loads the paper sheet P in a stacked state on an inner bottom surface which is a loading surface, it is possible to accommodate the paper sheet P on a lower side of the liquid accommodation portion 30. As illustrated by a dotted line arrow K1 in FIG. 1, by a transporting mechanism (not illustrated) provided in the printer main body 12, the accommodated paper sheet P is supplied (fed) to the liquid ejecting head 16 through a supply path KK (refer to FIG. 6) provided on a rear direction (−Y direction) side of the liquid accommodation portion 30 in the printer main body 12 from the supply cassette 40.

In other words, the supply cassette 40 is provided with an accommodation area SP which accommodates the paper sheet P in a stacked state and an installation area SL of the liquid accommodation portion 30 on an upper side of the accommodation area SP. In the installation area SL, a storage portion 32 which stores the liquid accommodation portion 30 is provided, and the storage portion 32 is attached to be movable in the front-and-rear direction (±Y direction) in the supply cassette 40. In other words, the storage portion 32 partitions the accommodation area SP and the installation area SL so that at least parts of the accommodation area SP and the installation area SL are overlapped with each other when viewed from the stacking direction of the paper sheet P. In a state where the supply cassette 40 is inserted into the printer main body 12, the liquid accommodation portion 30 installed in the supply cassette 40 functions as a partitioning member which partitions the accommodation area SP and the installation area SL to be positioned closer to the anti-gravity direction (+Z direction) side in the stacking direction than the paper sheet P accommodated in the supply cassette 40. In addition, according to an attachment position in an up-and-down direction (±Z direction) of the storage portion 32, the occupancy ratio between the accommodation area SP and the installation area SL is set.

Next, the discharging portion 20, the liquid accommodation portion 30, and the supply cassette 40 will be described.

Figure 2:
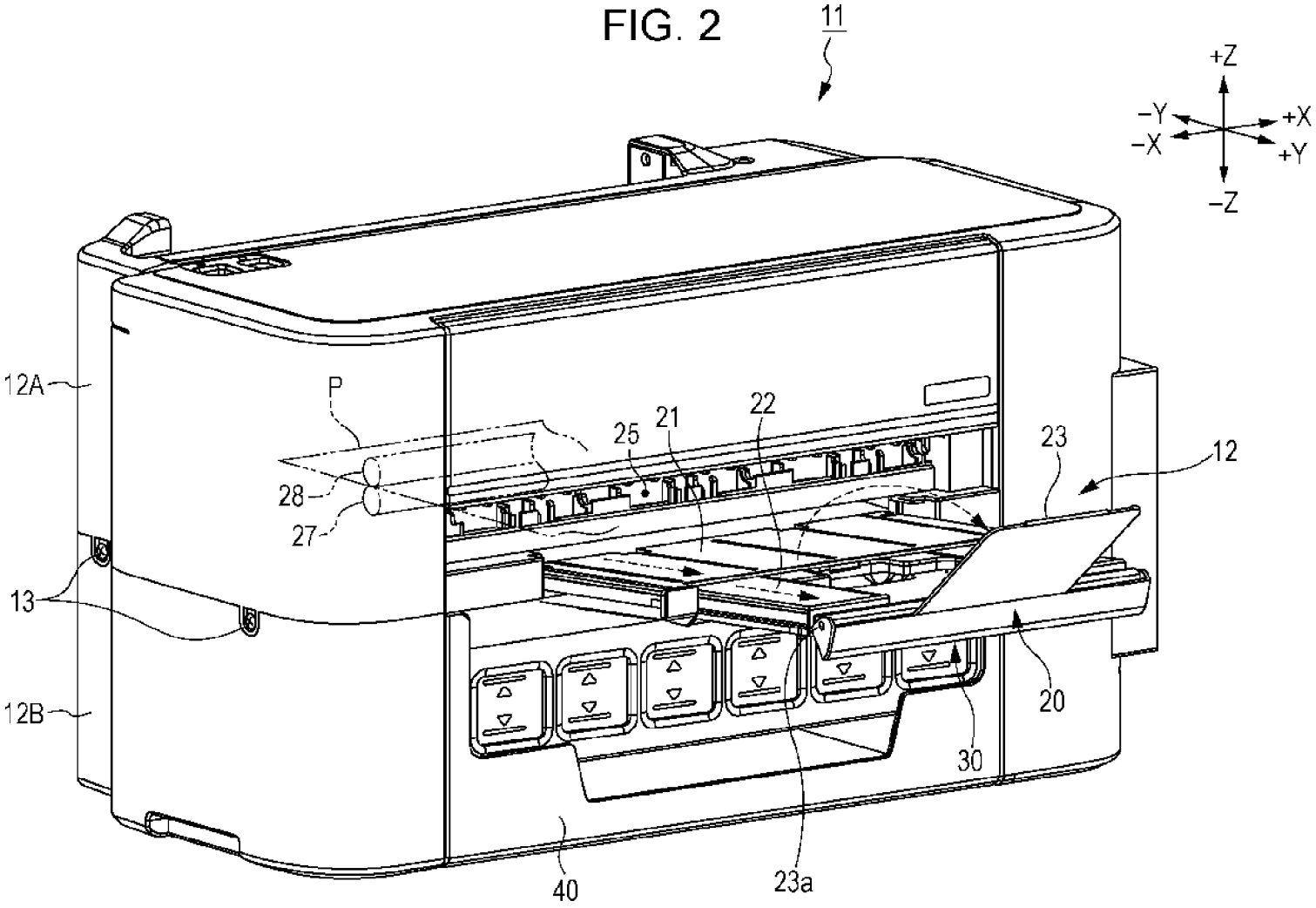
FIG. 2 is a perspective view illustrating a configuration of a discharging portion of a paper sheet provided in the printer.

First, as illustrated in FIG. 2, the discharging portion 20 is provided with a first supporting base 21 which is drawable to the front side (+Y direction side) from the printer main body 12, and a second supporting base 22 which is drawable to the front side from the first supporting base 21. Furthermore, a third supporting base 23, which is supported to be rotatable around a rotation axis 23*a* which considers a right-and-left direction (±X direction) at a front side end portion of the second supporting base 22 as an axial line, is provided. The discharging portion 20 supports the paper sheet P which is discharged from the printer main body 12 after printing, from the lower side.

In other words, as illustrated by a dotted line arrow in FIG. 2, in the discharging portion 20, first, the second supporting base 22 is drawn out to slide and move forward from the first supporting base 21 (printer main body 12). Next, the first supporting base 21 slides and moves forward together with the second supporting base 22, and is drawn out from the printer main body 12. Furthermore, in the third supporting base 23, a tip end portion thereof rotates to be lifted to a closer side from a rear side, and is drawn out from the second supporting base 22. In addition, in the discharging portion 20, when printing on the paper sheet P is not performed, as illustrated in FIG. 1, the first supporting base 21, the second supporting base 22, and the third supporting base 23 are in a state of being stored in the printer main body 12.

In addition, as illustrated in FIGS. 1 and 2, in the discharging portion 20, a discharging port 25 is formed in front of the printer main body 12, and from the discharging port 25, discharging is performed to the front side of the printer main body 12 which is the discharging direction side by discharging means of the paper sheet P. Therefore, in the embodiment, upper surface of each of supporting bases 21, 22, and 23 which is drawn out to the discharging direction side of the paper sheet P is a discharging area of the paper sheet P, and supports the paper sheet P from the lower side. In addition, in the discharging portion 20, when printing on the paper sheet P is not performed, as illustrated in FIG. 1, the first supporting base 21, the second supporting base 22, and the third supporting base 23 are in a state of being stored in the printer main body 12.

In addition, as illustrated in FIG. 2, in the embodiment, in the printer main body 12, discharging means is provided which has a pair of rollers including a discharging roller 27 which discharges the printed paper sheet P and a driven roller 28 which is disposed facing the discharging roller 27. Therefore, the discharging portion 20 is formed to have the discharging area on the discharging direction side of the paper sheet P, from discharging means. Originally, other than the pair of rollers, other configurations, such as a transporting belt, can be employed as discharging means.

Figure 3:
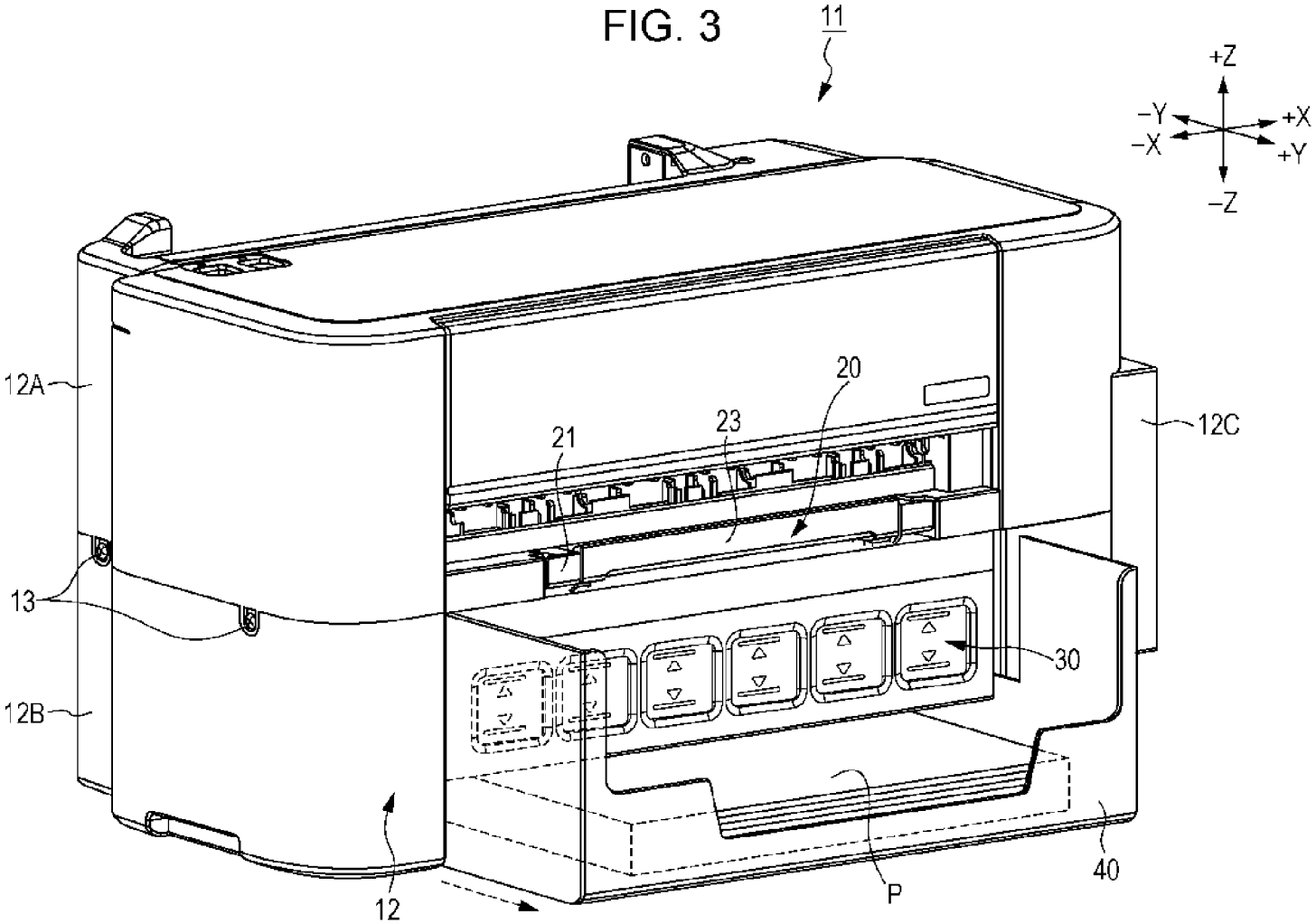
FIG. 3 is a perspective view illustrating a configuration of a supply cassette of the paper sheet provided in the printer.

Next, as illustrated in FIG. 3, the supply cassette 40 which is provided with the liquid accommodation portion 30 is slidable in the front-and-rear direction (±Y direction) with respect to the printer main body 12 (lower side case 12B) and can be inserted into and extracted from the front side (front surface side) of the printer main body 12, by a slide structure (not illustrated). When the paper sheet P is accommodated in the supply cassette 40, the supply cassette 40 is extracted to the front side from the printer main body 12 (lower side case 12B) as illustrated by a dotted line arrow in FIG. 3, and can accommodate the paper sheet P in a stacked state on the inner bottom surface of the supply cassette 40 from the closer side of the liquid accommodation portion 30. After accommodating the paper sheet P, the supply cassette 40 is inserted into the printer main body 12 as illustrated in FIG. 1.

Figure 4:
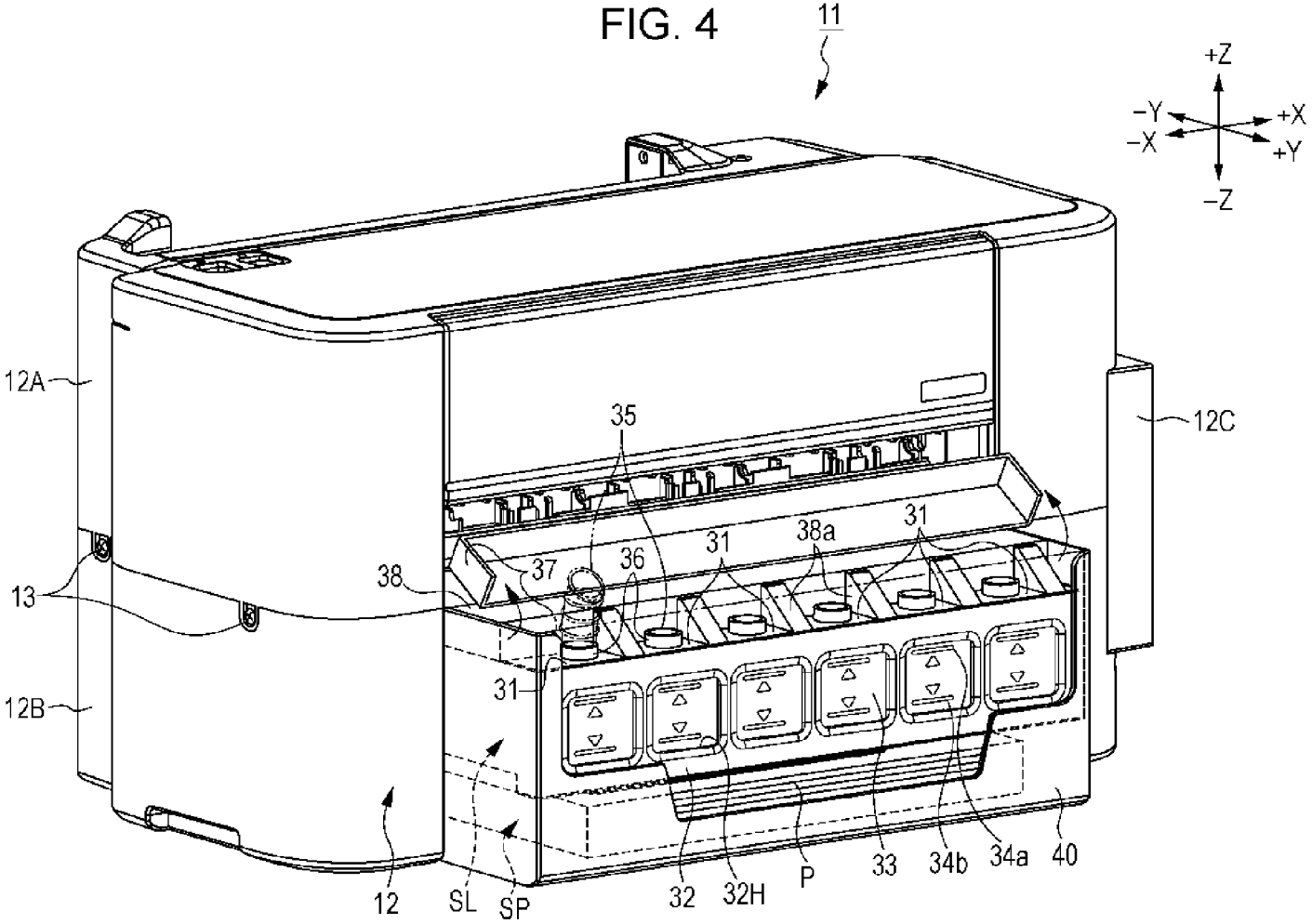
FIG. 4 is a perspective view illustrating a configuration of a liquid accommodation portion provided in the supply cassette.

Next, as illustrated in FIG. 4, in a state where the supply cassette 40 is extracted from the printer main body 12, the liquid accommodation portion 30 can slide and move in the front-and-rear direction (±Y direction). In other words, in the embodiment, the liquid accommodation portion 30 is formed in a substantial box shape in which the upper side provided with the supply cassette 40 is open, and is accommodated in the storage portion 32 (refer to FIG. 6) which functions as the partitioning member that partitions the installation area SL and the accommodation area SP. In the storage portion 32, on both side surfaces of the right-and-left direction (±X direction), a slide mechanism (not illustrated) of the storage portion 32 which can freely move in the front-and-rear direction (±Y direction) with respect to the supply cassette 40, is provided as a moving mechanism.

Therefore, by sliding and moving the storage portion 32, the liquid accommodation portion 30 can slide and move in the front-and-rear direction (±Y direction) in the supply cassette 40. By sliding and moving, at least a part of the liquid accommodation portion 30 is configured to be drawn out to the outside of the printer main body 12.

In addition, in the embodiment, when the supply cassette 40 is drawn out from the printer main body 12, by an operation of the slide mechanism, the liquid accommodation portion 30 stays in the printer main body 12 without moving to the front side together with the supply cassette 40. Originally, the liquid accommodation portion 30 may be configured to be drawn out from the printer main body 12 together with the supply cassette 40. In this case, when the paper sheet P is accommodated in the supply cassette 40, the liquid accommodation portion 30 which is drawn out can be moved to the rear side by the slide mechanism, and can be positioned in the printer main body 12 as illustrated in the FIG. 3.

In the embodiment, the liquid accommodation portion 30 in which at least a part thereof is drawn out to the outside of the printer main body 12 has six liquid accommodation bodies 31 (refer to FIG. 5B) which accommodate different types (for example, colors) of ink from each other. In a state where the six liquid accommodation bodies 31 can be separated individually, the liquid accommodation portion 30 is aligned in a row in the right-and-left direction (±X direction) which is the scanning direction and is stored in the storage portion 32. In addition, each liquid accommodation body 31 is a substantially box-shaped container, a so-called ink tank which is formed of a material (resin or metal) having rigidity that can accommodate the ink inside.

In addition, each liquid accommodation body 31 may be stored in the storage portion 32 in a state of being combined with the others. In addition, each liquid accommodation body 31 may not necessarily accommodate six different types of ink, and may accommodate two or more and five or less types of ink. Otherwise, one type (for example, black color) of ink may be accommodated in the plurality (here, maximum of six) of liquid accommodation bodies 31. Furthermore, the plurality of liquid accommodation bodies 31 in which the same type (for example, black color) of ink is accommodated may be linked as one liquid accommodation body 31.

In addition, the liquid accommodation portion 30 is provided with a liquid amount visual confirmation portion 33 which can visually confirm a liquid amount (residual amount) of the ink accommodated in each liquid accommodation body 31. The liquid amount visual confirmation portion 33 is an area of the liquid accommodation portion 30 (liquid accommodation body 31) which can visually confirm the liquid amount via a through hole 32H in a substantially rectangular shape provided on the front side surface of the storage portion 32, and is formed to visually confirm a liquid surface of the ink in the liquid accommodation body 31. Furthermore, in the liquid amount visual confirmation portion 33, the liquid accommodation portion 30 has a lower limit liquid surface line 34*b* which indicates that the ink is required to be poured into liquid accommodation body 31, and an upper limit liquid surface line 34*a* which indicates a pouring limit of the ink into the liquid accommodation body 31.

In addition, the liquid accommodation portion 30 is provided with six pouring ports 35 which can respectively pour the ink into each liquid accommodation body 31. Each pouring port 35 is an opening on one end side of a cylinder portion 36 which is protruded to the upper side in an upper surface front end portion of each liquid accommodation body 31. In other words, the inside of a cylinder of each cylinder portion 36 is a communication hole in which one end side opens into the air and the other end side opens into the inside of the liquid accommodation body 31, and an opening on one end side which opens into the air in the communication hole functions as the pouring port 35. According to this, it is possible to pour the ink into the liquid accommodation body 31.

Furthermore, in the embodiment, a bellows portion which can extend and contract is formed in the cylinder portion 36, and the bellows portion extends and contracts. According to this, the pouring port 35 is provided to be displaceable with respect to the printer main body 12. For example, as the bellows portion extends as illustrated by a two-dot chain line in FIG. 4, the pouring port 35 is displaceable to be apart from the printer main body 12.

In addition, although not illustrated in FIG. 4, in each liquid accommodation body 31, a cap for preventing leakage or evaporation of the ink from the pouring port 35 is attached to the pouring port 35 as necessary. Originally, when pouring the ink, the cap is detached from the pouring port 35.

In addition, in order to suppress attachment of foreign matters to the pouring port 35 or the vicinity of the pouring port 35, the liquid accommodation portion 30 is provided with a first cover member 37 which covers an upper surface of each liquid accommodation body 31, and a second cover member 38. The first cover member 37 is positioned on the front side of the second cover member 38 to cover the pouring port 35, and is attachable to and detachable from the upper surfaces of each liquid accommodation body 31. In other words, by detaching the first cover member 37 as illustrated by a solid line arrow in FIG. 4, the pouring ports 35 of each liquid accommodation body 31 are configured to be exposed.

In addition, in the second cover member 38, six separation walls 38*a* in a substantially triangular shape are formed corresponding to the cylinder portions 36 of each liquid accommodation portion 30. The separation wall 38*a* suppresses the flow of the ink so that the ink spilled from the pouring port 35 does not flow into another pouring port 35 or the ink spilled from the pouring port 35 stays on the periphery of the cylinder portion 36 provided with the pouring port 35.

Figure 5A:
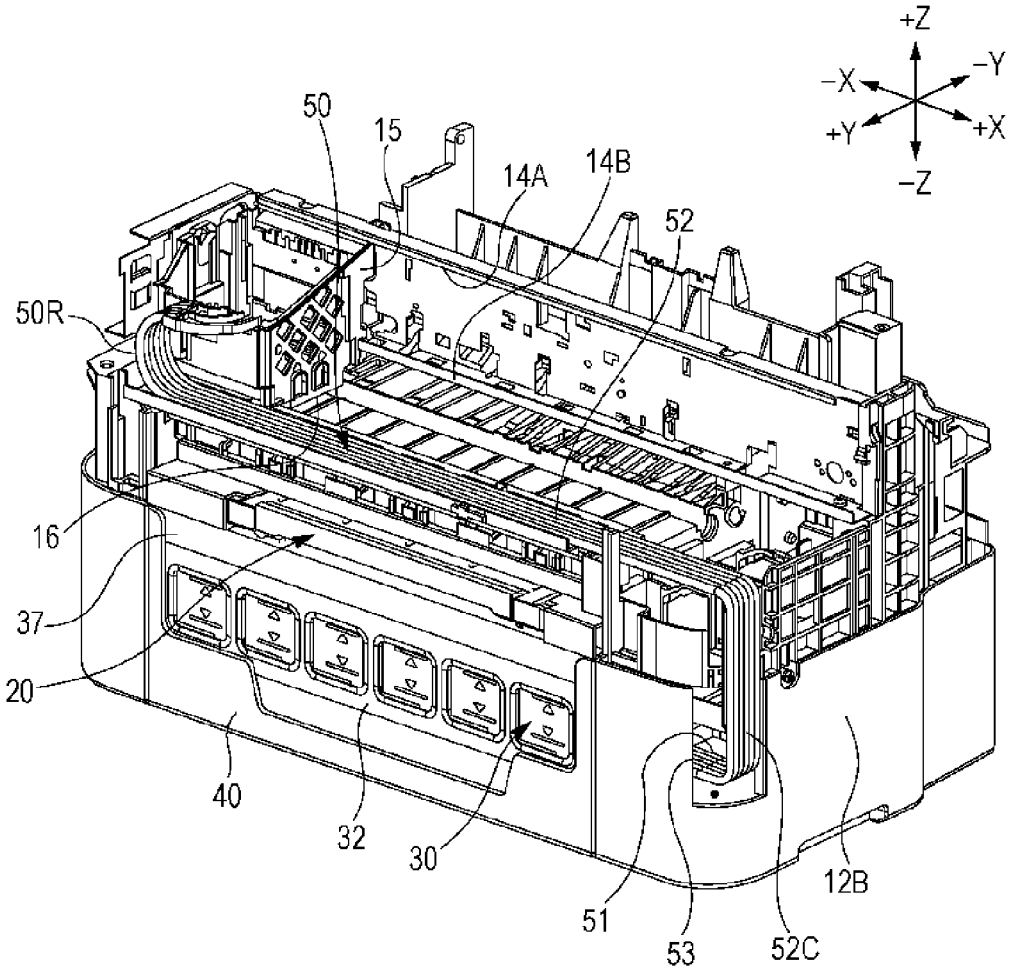
FIGS. 5A and 5B are perspective views illustrating an arrangement state of a liquid supply tube.
Figure 5B:
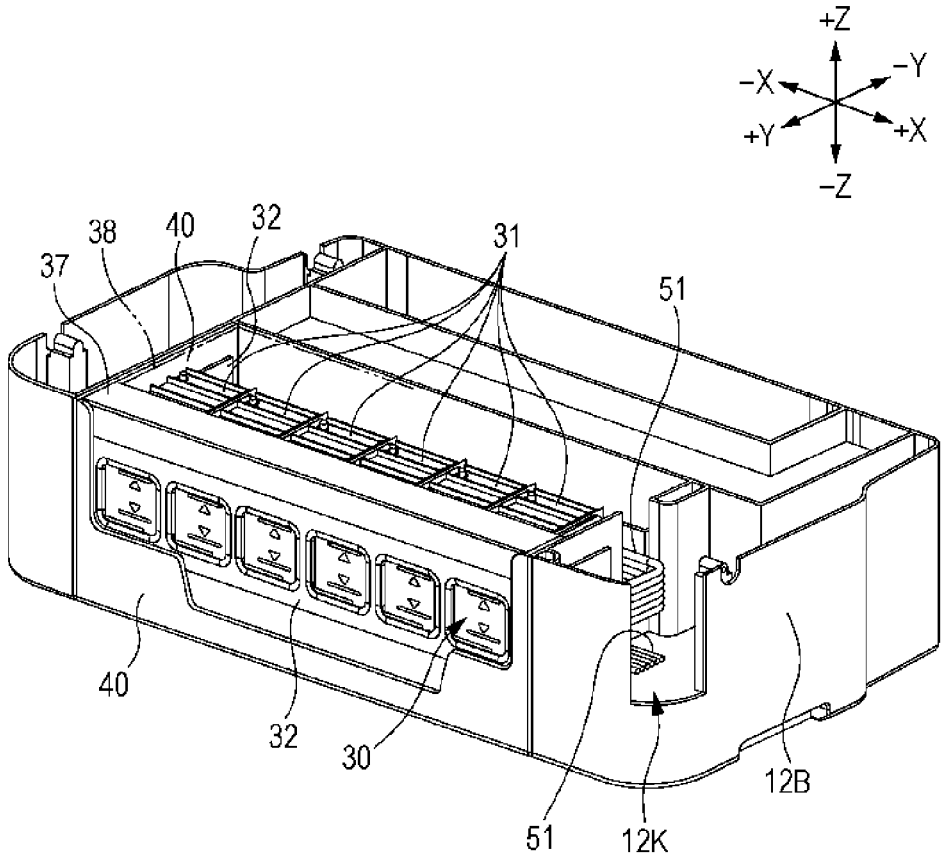

Next, with reference to FIGS. 5A and 5B and FIG. 6, an arrangement state of the liquid supply tubes 50 which supply the ink from the liquid accommodation portion 30 to the liquid ejecting head 16 will be described. In addition, FIG. 5A illustrates a view in a state where the upper side case 12A of the printer main body 12 is removed from the printer 11. FIG. 5B illustrates a view in a state where a configuration member which is positioned further upward than the liquid accommodation portion 30 and the second cover member 38 are further removed in FIG. 5A. In addition, FIG. 6 illustrates a view in a state where the state of FIG. 5B is viewed from a different direction.

Figure 6:
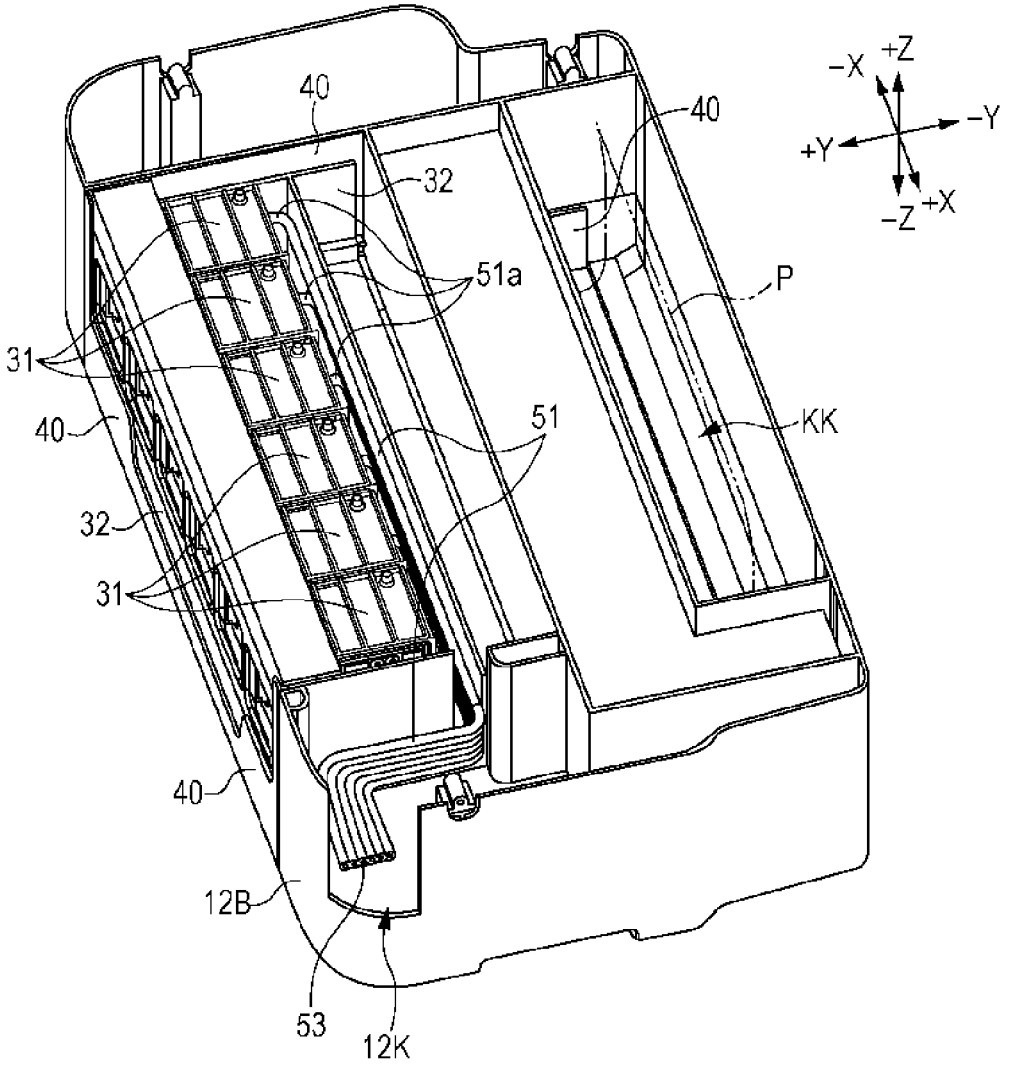
FIG. 6 is a perspective view illustrating a connection state of the liquid supply tube to the liquid accommodation portion.

As illustrated in FIGS. 5A and 5B and FIG. 6, in the printer 11, the ink is supplied by each liquid supply tube 50 from each liquid accommodation body 31 of the liquid accommodation portion 30 provided in the lower side case 12B of the printer main body 12 to the carriage 15 (liquid ejecting head 16) which is positioned further upward than the discharging portion 20. In other words, in each liquid supply tube 50, one end 51*a* thereof having flexibility is connected to an end portion on the opposite direction (−Y direction) side to the extracting direction (+Y direction) with respect to the liquid accommodation portion 30, and communicates with each liquid accommodation body 31. In the liquid supply tube 50, in the right-and-left direction (±X direction) which intersects with the extracting direction (+Y direction) of the supply cassette 40, on the outer side of the discharging portion 20, a curved flow path portion 52C in a substantial C shape which supplies the ink from the lower side (−Z direction side) to the upper side (+Z direction side) of the discharging portion 20 is arranged. In other words, as the curved flow path portion 52C is positioned on the outer side of a right direction (+X direction) of the discharging portion 20 when viewed from a front surface side of the printer main body 12, the liquid supply tube 50 is configured not to be engaged with the paper sheet P discharged from the discharging portion 20.

Furthermore, on the upper side of the discharging portion 20, after the liquid supply tube 50 is arranged to be extended toward the left direction (−X direction) from the curved flow path portion 52C, the other end of the liquid supply tube 50 forms the curved portion 50R which is curved in a substantial half circle shape and is connected to the carriage 15. Therefore, after the ink which flows out from the liquid accommodation portion 30 flows to the upper side from the lower side of the curved flow path portion 52C positioned at the outer side end portion of the right direction (+X direction) of the discharging portion 20, the ink further flows in the curved portion 50R of the liquid supply tube 50 and flows into the carriage 15.

As a result, in the liquid supply tube 50, the curved portion 50R functions as a deformation movable portion which performs the following deformation while changing a formation position according to a movement of the carriage 15, and supplies the ink from the liquid accommodation portion 30 to the carriage 15 that moves. The ink supplied to the carriage 15 is supplied to the liquid ejecting head 16 via the ink flow path (not illustrated) provided in the carriage 15. In this manner, in the printer 11, it is possible to supply the ink by the liquid supply tube 50 having flexibility from the liquid accommodation portion 30 provided on the lower side of the printer main body 12 to the liquid ejecting head 16 provided on the upper side of the printer main body 12.

In the embodiment, a length of the arranged liquid supply tube 50 which supplies the ink from the liquid accommodation portion 30 to the liquid ejecting head 16 is substantially constant regardless of a size of the supply cassette 40. For example, even when an accommodation space of the paper sheet P is the thick supply cassette 40 which is long in the up-and-down direction (±Z direction) so that the supply cassette 40 can supply relatively large number of paper sheets P, since the liquid accommodation portion 30 is positioned right below the discharging portion 20, the liquid accommodation portion 30 and the liquid ejecting head 16 are not far apart from each other.

In addition, in the embodiment, each liquid supply tube 50 is configured by at least two tubes which can be disconnected or connected. In other words, as illustrated in FIGS. 5A and 5B, each liquid supply tube 50 has an upstream side tube 51 which is connected to the liquid accommodation portion 30, and a downstream side tube 52 which is connected to the carriage 15. The upstream side tube 51 can be disconnected from or connected to the downstream side tube 52 by a connection portion 53 provided on an upstream end of the curved flow path portion 52C. Openings 12K for performing a disconnection operation or a connection operation between the upstream side tube 51 and the downstream side tube 52 are respectively provided in the upper side case 12A and the lower side case 12B. In addition, in the embodiment, in each drawing, the opening 12K of the upper side case 12A is omitted and not illustrated.

In addition, in the embodiment, the lid case 12C is configured to cover so that the curved flow path portions 52C of each liquid supply tube 50 are not exposed. In other words, the lid case 12C is attached to be attachable to and detachable from the printer main body 12 so that the openings 12K provided in the upper side case 12A and the lower side case 12B, respectively, are blocked (for example, refer to FIG. 1). When the disconnection operation or the connection operation between the upstream side tube 51 and the downstream side tube 52 is performed, the lid case 12C is detached from the printer main body 12, and after the disconnection operation or the connection operation between the upstream side tube 51 and the downstream side tube 52 is completed, the lid case 12C is attached to the printer main body 12.

Next, with reference to FIGS. 1, 3, and 4, an operation of the embodiment, that is, a pouring operation which pours (replenishes) the ink into the liquid accommodation portion 30 (liquid accommodation body 31) when the ink which is supplied from the liquid accommodation portion 30 to the liquid ejecting head 16 runs out, will be described. The pouring operation is performed by an ink pouring operator (simply called an "operator"), such as a consignor who is consigned to pour the ink or a user of the printer 11.

As illustrated in FIG. 3, when pouring the ink into the liquid accommodation portion 30 (liquid accommodation body 31), first, the operator draws out the supply cassette 40 by a movement amount which is equal to or greater than a minimum drawing amount set in advance, to the front surface side which is a front (+Y direction) side from the printer main body 12. In the drawing operation, on the front surface side of the printer main body 12, in general, a drawing space which is occupied by the drawn-out supply cassette 40 for accommodating the paper sheet P is ensured. Therefore, on the front surface side (front side) of the printer main body 12 having the drawing space, the operator can perform the drawing operation of the supply cassette 40 without moving the printer 11. In addition, the minimum drawing amount of the supply cassette 40 will be described later.

As illustrated in FIG. 4, next, the operator draws out the liquid accommodation portion 30 which is positioned in the printer main body 12 by the slide mechanism provided in the storage portion 32 to the front (+Y direction) side together with the storage portion 32 from the printer main body 12. For example, the operator holds and draws out a front part of the liquid accommodation portion 30 by using a lower side space of the liquid accommodation portion 30 (storage portion 32) which is formed by drawing out the supply cassette 40.

At this time, since the liquid accommodation portion 30 which is drawn out moves in the supply cassette 40 which is already drawn out, the operator can perform the drawing operation of the liquid accommodation portion 30 from the front surface side (front side) of the printer main body 12 without moving the printer 11. By the drawing operation of the operator, up to the storage portion 32 (liquid accommodation portion 30) which moves to the front side abuts against the supply cassette 40, at least a part of the liquid accommodation portion 30 is drawn out to be positioned on the outside of the printer main body 12.

In the embodiment, the first cover member 37 is drawn out to be positioned on the outside of the printer main body 12 as a part of the liquid accommodation portion 30. Therefore, in a state where the storage portion 32 abuts against the supply cassette 40, the movement amount of the supply cassette 40 which is in a state where the first cover member 37 of the liquid accommodation portion 30 is drawn out to the outside of the printer main body 12 is the minimum drawing amount. Originally, the supply cassette 40 is drawn out by the movement amount which is equal to or greater than the minimum drawing amount by the operator.

Next, the operator opens the first cover member 37 of the liquid accommodation portion 30 which is drawn out to the outside of the printer main body 12 and exposes the pouring port 35 in this manner, and extends the bellows portion of the cylinder portion 36 as necessary and displaces the pouring port 35 onto the upper side. Then, the operator pours the ink into the liquid accommodation body 31 from the pouring port 35 which is exposed or displaced in this manner, and makes the liquid accommodation portion 30 filled with the ink.

When pouring the ink, the operator can confirm the liquid amount of the ink which is poured into the liquid accommodation portion 30 (liquid accommodation body 31) by the liquid amount visual confirmation portion 33 provided on the front surface side of the printer main body 12. Therefore, the operator can easily pour the ink into each liquid accommodation body 31 of the liquid accommodation portion 30 up to the upper limit liquid surface line 34*a* which indicates the pouring limit of the ink.

As illustrated in FIG. 1, the liquid accommodation portion 30 which is filled with the ink in this manner is pushed in and inserted into the printer main body 12 together with the supply cassette 40 which accommodates the paper sheet P. As a result, the printer 11 is in a printable state where the paper sheet P and the ink are supplied from the supply cassette 40 to the liquid ejecting head 16. In the printer 11 in the printable state, the liquid accommodation portion 30 pushed in the printer main body 12 is provided at a position of being overlapped with the supply cassette 40 in the vertical direction. Therefore, the liquid accommodation portion 30 is provided in the printer 11 in a state where an increase in an area of the printer main body 12 when viewed from the vertical direction, that is, an area of the printer main body 12 which is occupied when the printer 11 is installed, is suppressed.

According to the above-described embodiment, it is possible to achieve the following effects.

(1) It is possible to move at least the first cover member 37 of the liquid accommodation portion 30 to the outside of the printer main body 12 by extracting the supply cassette 40. Therefore, when getting access the liquid accommodation portion 30, the operator can access the liquid accommodation portion 30 from an extraction side of the supply cassette 40 and easily make the liquid accommodation portion 30 filled with the ink, without moving the printer 11. In addition, since the liquid accommodation portion 30 is provided in the supply cassette 40, the liquid accommodation portion 30 is installed at a position where the liquid accommodation portion 30 and the supply cassette 40 are overlapped with each other in the vertical direction in the printer main body 12 by inserting the supply cassette 40. As a result, the increase in the installation area of the printer 11 is suppressed.

(2) By the storage portion 32 which partitions the accommodation area SP and the installation area SL, it is possible to accommodate and install the paper sheet P and the liquid accommodation portion 30 in the supply cassette 40 in a state where the accommodation area SP and the installation area SL do not interrupt each other in the supply cassette 40.

(3) Since it is possible to easily access the liquid accommodation portion 30 which is positioned further upward than the paper sheet P in the supply cassette 40, it is possible to easily make the liquid accommodation portion 30 filled with the ink for recording.

(4) By moving the attachment position of the storage portion 32 in the supply cassette 40, it is possible to appropriately change an occupancy ratio between the accommodation area SP and the installation area SL, for example, according to a capacity (size or number of paper sheets) of the accommodated paper sheet P, or a capacity of the installed liquid accommodation portion 30.

(5) By the storage portion 32 which is provided to be movable in the supply cassette 40, it is possible to move at least a part of the liquid accommodation portion 30 to the outside of the apparatus main body.

(6) Since the liquid accommodation portion 30 is installed on the extracting direction side (front side) from the printer main body 12 in the supply cassette 40, it is possible to reliably move at least a part (first cover member 37) of the liquid accommodation portion 30 to the outside of the printer main body 12. In addition, it is possible to easily visually confirm the ink accommodation amount (ink residual amount) in the liquid accommodation portion 30.

(7) As the operator pours the ink into the liquid accommodation portion 30 provided in the supply cassette 40 from the pouring port 35, it is possible to easily make the liquid accommodation portion 30 filled with the ink.

(8) When getting access to the liquid accommodation portion 30, since the operator can access the liquid accommodation portion 30 from the extracting direction of the supply cassette 40 without being disturbed by the liquid supply tube 50, and it is possible to easily make the liquid accommodation portion 30 filled with the ink.

In addition, the above-described embodiment may be changed into another embodiment as follows.

In the above-described embodiment, the storage portion 32 may have a configuration in which the supply cassette 40 can slide and move to the front side in a state of not being drawn out from the printer main body 12. In other words, without drawing out the supply cassette 40 from the printer main body 12, a configuration in which the liquid accommodation portion 30 can be drawn out to the outside of the printer main body 12 may be employed. In this case, it is preferable that the liquid accommodation portion 30 be drawn out up to a position where the pouring operation of the ink to at least the pouring port 35 is possible.

In the above-described embodiment, the supply cassette 40 may not have a configuration in which the paper sheet P is necessarily accommodated on the lower side of the liquid accommodation portion 30. For example, the storage portion 32 partitions the accommodation area SP and the installation area SL so that at least parts of the accommodation area SP and the installation area SL are overlapped with each other when viewed from the stacking direction of the paper sheet P. In a state where the supply cassette 40 is inserted into the printer main body 12, the liquid accommodation portion 30 installed in the supply cassette 40 may have a configuration in which the liquid accommodation portion 30 is positioned to be closer to the gravity direction side (lower side) in the stacking direction than the paper sheet P accommodated in the supply cassette 40. A modification example will be described with reference to the drawings.

Figure 7:
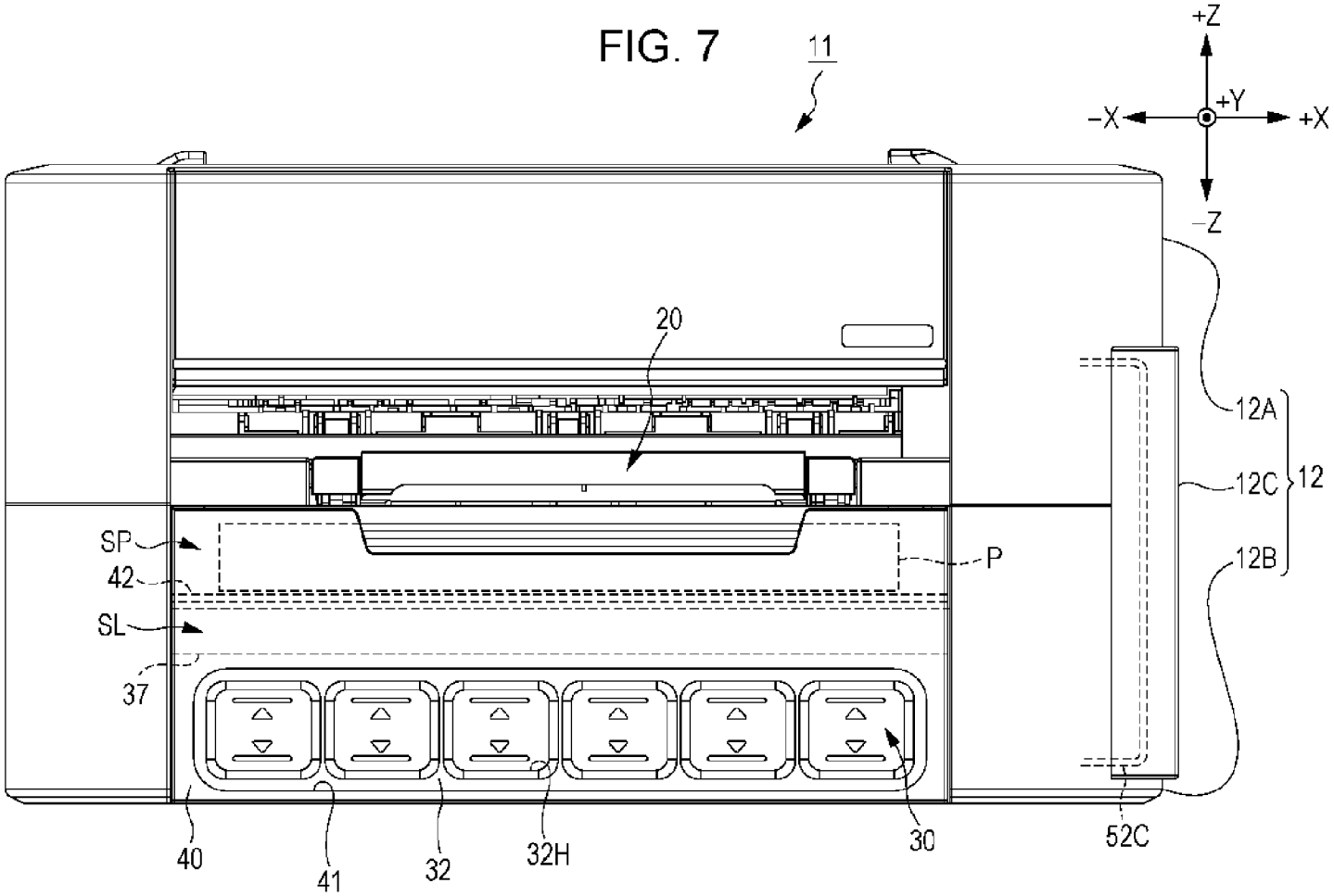
FIG. 7 is a front view illustrating the printer in which the liquid accommodation portion is positioned on a lower side in the supply cassette.

As illustrated in FIG. 7, in the supply cassette 40, a loading plate 42 having a loading surface for loading the paper sheet P on a upper side thereof is provided as the partitioning member, and the liquid accommodation portion 30 is provided on a lower side of the loading plate 42. In other words, in the supply cassette 40, by the loading plate 42, the upper side area thereof is partitioned as the accommodation area SP of the paper sheet P, and a lower side area thereof is partitioned as the installation area SL of the liquid accommodation portion 30. In the supply cassette 40, the liquid accommodation portion 30 is an end portion of the extracting direction (+Y direction) side of the supply cassette 40, and is disposed on the lower side (−Z direction) of the paper sheet P accommodated in the supply cassette 40. The through hole 32H of the storage portion 32 is configured to be exposed so that the through hole 32H is visually confirmed from the front side, via a through hole 41 provided on a front surface of the supply cassette 40. Therefore, although not illustrated in the drawings, the supply path KK of the paper sheet P which is supplied from the supply cassette 40 to the liquid ejecting head 16 is formed closer to the upper (+Z direction) than the liquid accommodation portion 30.

According to the modification example, the following effect will be achieved instead of the effect (3) of the above-described embodiment.

(9) Since the paper sheet P is disposed on the anti-gravity direction of the liquid accommodation portion 30 in the supply cassette 40, a probability that the ink moves to the paper sheet P side is low. Therefore, contamination caused by the ink of the paper sheet P accommodated in the supply cassette 40 is suppressed. In addition, since the supply path KK of the paper sheet P is not required to be provided, an occupied area (accommodation area SP) of the liquid accommodation portion 30 allowed in the supply cassette 40 can be larger in an insertion and extraction direction (±Y direction) of the supply cassette 40 than that in the above-described embodiment.

In addition, although not illustrated in the modification example, in the loading plate 42, an opening portion which can detach the first cover member 37 from the liquid accommodation portion 30 is formed in an area which is positioned on the upper side of the first cover member 37. A configuration in which the ink can be poured into the liquid accommodation portion 30 via the opening is employed. In addition, since the liquid accommodation portion 30 is disposed on the lower side of the supply cassette 40, compared to a case of the above-described embodiment, a length in the up-and-down direction of the curved flow path portion 52C as illustrated by dotted line in FIG. 7 becomes long. In addition, the lid case 12C which covers the long curved flow path portion 52C is also formed to be long in a vertically long shape.

In the above-described embodiment and the modification example, the partitioning member may employ another configuration other than the storage portion 32 or the loading plate 42. A schematic view of this modification example will be described with reference to the drawings.

Figure 8A:
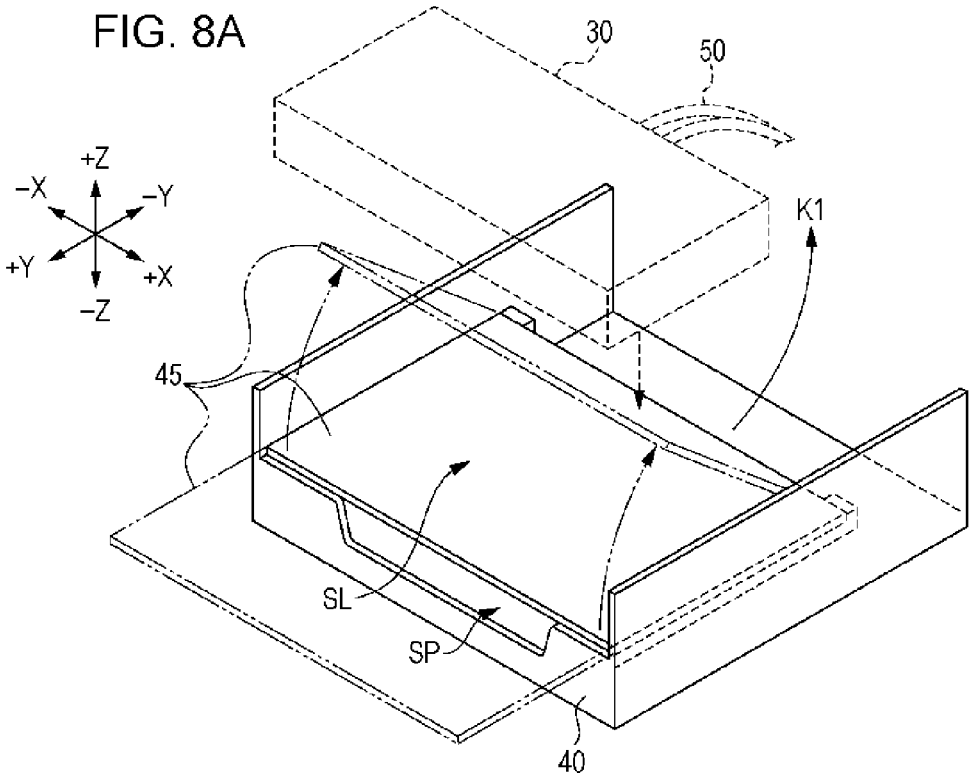
FIGS. 8A and 8B are schematic perspective views of the supply cassette illustrating an accommodation area of the paper sheet and an installation area of the liquid accommodation portion which are partitioned to be overlapped with each other in a stacking direction of the paper sheet.
Figure 8B:
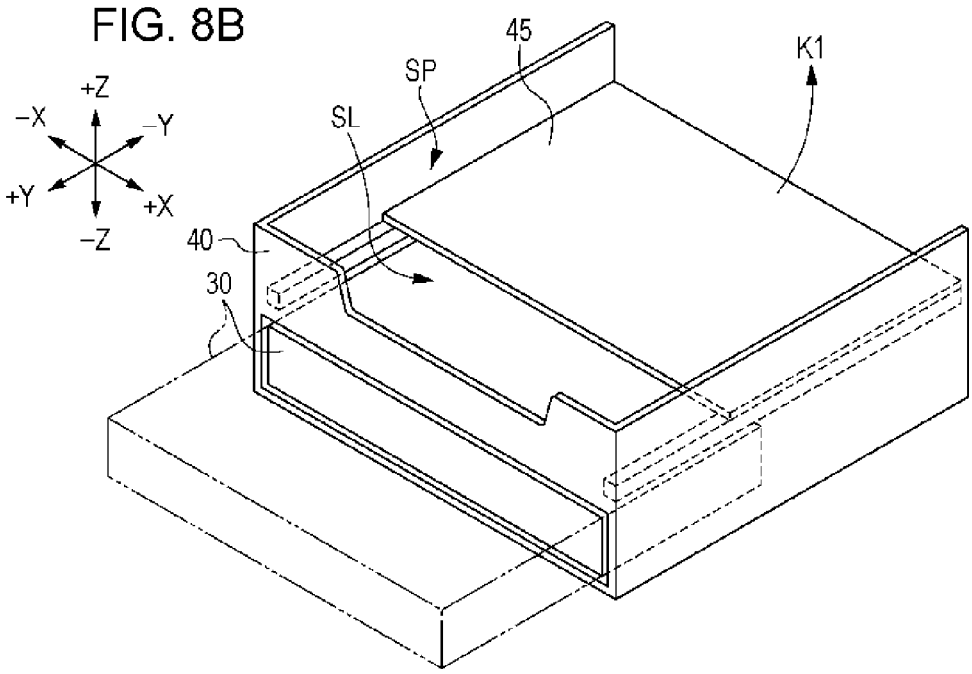

As schematically illustrated in FIGS. 8A and 8B, a division plate 45 which divides an area in the supply cassette 40 is provided in the supply cassette 40. The division plate 45 functions as the partitioning member which partitions the area in the supply cassette 40 into two areas including the accommodation area SP of the paper sheet P and the installation area SL of the liquid accommodation portion 30, in the up-and-down direction which is the stacking direction of the paper sheet P.

In other words, as illustrated in FIG. 8A, a spatial area on the upper side of the division plate 45 is the installation area SL of the liquid accommodation portion 30, and the liquid accommodation portion 30 is loaded and accommodated on the upper surface of the division plate 45. Therefore, the division plate 45 functions as a loading member which loads the liquid accommodation portion 30. In addition, a spatial area on the lower side of the division plate 45 is the accommodation area SP of the paper sheet P. The paper sheet P accommodated in the accommodation area SP is sent out to the supply path KK from a rear side as illustrated by an arrow K1.

In addition, at least a part of the division plate 45 may be provided in the supply cassette 40 in a state of being movable to the upper side which is opposite to the accommodation area SP side. By this configuration, it is possible to form a void so that the operator can hold up the division plate 45 when accommodating the paper sheet P in the supply cassette 40, and can accommodate the paper sheet P between the division plate 45 and the supply cassette 40.

In addition, the division plate 45 is provided to be movable in the front-and-rear direction in a state of being inserted into the printer main body 12, and may be configured to be movable to the front side as illustrated by a two-dot chain line in FIG. 8A. In this configuration, the liquid accommodation portion 30 which is loaded on the upper surface can be moved to the outside of the printer main body 12 when pouring the ink. Originally, without moving the division plate 45, the liquid accommodation portion 30 may be configured to move to the outside of the printer main body 12 by drawing out the supply cassette 40.

Otherwise, as illustrated in FIG. 8B, the spatial area on the upper side of the division plate 45 may be the accommodation area SP of the paper sheet P, and the paper sheet P may be loaded and accommodated on an upper surface of the division plate 45. In this configuration, similarly to the loading plate 42 in the above-described modification example, the upper surface of the division plate 45 may function as the loading surface of the paper sheet P. In addition, the spatial area of the lower side of the division plate 45 is the accommodation area SP of the liquid accommodation portion 30. In this case, at least a part of the division plate 45 is provided in the supply cassette 40 in a state of being movable to the upper side. As the operator holds up the division plate 45 when pouring the ink into the liquid accommodation portion 30, a void for pouring the ink between the division plate 45 and the supply cassette 40 is formed.

In addition, the division plate 45 is provided to be movable in the front-and-rear direction in a state of being inserted into the printer main body 12, and as illustrated by a two-dot chain line in FIG. 8B, and the division plate 45 may be positioned on a rear side in the supply cassette 40 when printing. In this configuration, the division plate 45 can be positioned on a further rear side than the pouring port 35 when pouring the ink. Originally, without moving the division plate 45, for example, a configuration in which the liquid accommodation portion 30 can be drawn out to the outside of the printer main body 12 from the opening portion provided on the front side of the supply cassette 40, may be employed.

Figure 9A:
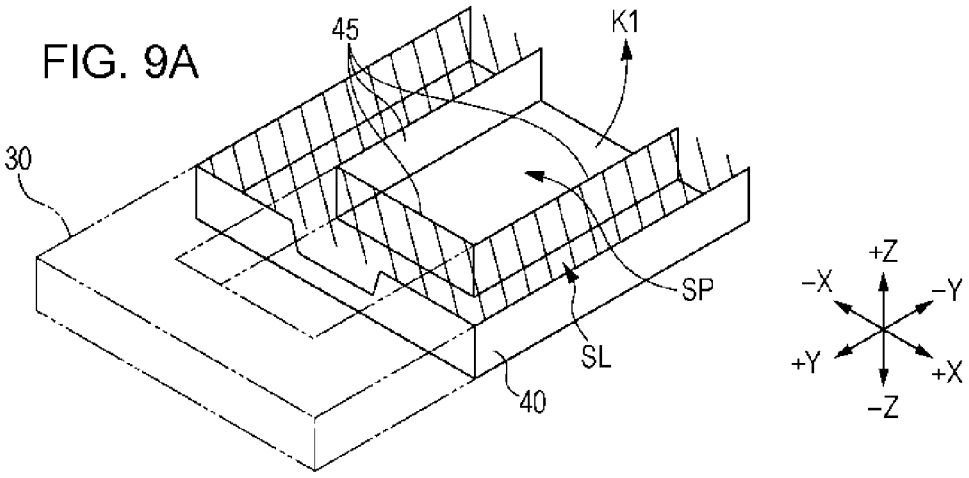
FIGS. 9A to 9C are schematic perspective views of the supply cassette illustrating the accommodation area of the paper sheet and the installation area of the liquid accommodation portion which are partitioned not to be overlapped with each other when viewed from a stacking direction of the paper sheet.
Figure 9B:
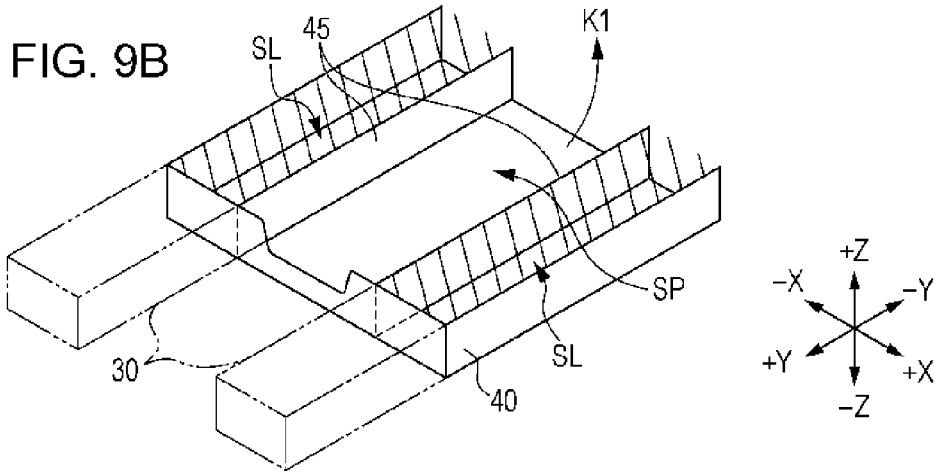
Figure 9C:
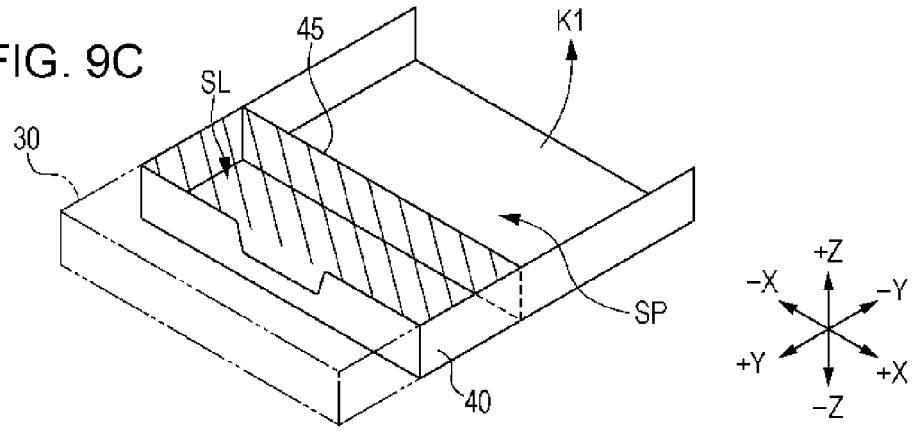

Otherwise, as schematically illustrated in FIGS. 9A, 9B, and 9C, the division plate 45 which is provided in the supply cassette 40 may be configured to divide (partition) the accommodation area SP and the installation area SL so that the accommodation area SP and the installation area SL are not overlapped with each other when viewed from the stacking direction of the paper sheet P.

For example, as illustrated as a hatching area in FIG. 9A, in a state where the supply cassette 40 is inserted into the printer main body 12, the division plate 45 may be configured to divide an end portion area of both sides and an end portion area of the front side of the right-and-left direction (±X direction) of the supply cassette 40 as the installation area SL of the liquid accommodation portion 30. In this configuration, the accommodation area SP which accommodates the paper sheet P is provided on the inner side of the installation area SL which is formed in a C shape when viewed from the up-and-down direction which is the stacking direction of the paper sheet P. The paper sheet P which is accommodated in the accommodation area SP is sent out to the supply path KK from the rear side as illustrated by an arrow K1.

Otherwise, as illustrated as a hatching area in FIG. 9B, in a state where the supply cassette 40 is inserted into the printer main body 12, the division plate 45 may be configured to divide each end portion area on both sides of the right-and-left direction (±X direction) of the supply cassette 40 as the installation area SL of the liquid accommodation portion 30. In this configuration, the accommodation area SP which accommodates the paper sheet P is provided in an area which is pinched between two installation areas SL when viewed from the up-and-down direction which is the stacking direction of the paper sheet P.

Otherwise, as illustrated as a hatching area in FIG. 9C, in a state where the supply cassette 40 is inserted into the printer main body 12, the division plate 45 may be configured to divide an end portion area of the front side (+Y direction) of the supply cassette 40 as the installation area SL of the liquid accommodation portion 30. In this configuration, the accommodation area SP which accommodates the paper sheet P is provided on the rear side of the installation area SL when viewed from the up-and-down direction which is the stacking direction of the paper sheet P.

In addition, as illustrated by two-dot chain lines in FIGS. 9A, 9B, and 9C, in each of the configurations of the division plate 45, it is preferable that the liquid accommodation portion 30 have a structure which is movable to the front side of the supply cassette 40 from the installation area SL. In this manner, without moving the supply cassette 40, when pouring the ink into the liquid accommodation portion 30, it is possible to easily draw out the pouring port 35 to the outside of the printer main body 12.

In this modification example, that is, with the configuration in which the accommodation area SP and the installation area SL are divided (partitioned) not to be overlapped with each other when viewed from the stacking direction of the paper sheet P, in addition to the effects (1), (2), and (6) to (8) of the above-described embodiment, the following effects will be achieved.

(12) For example, by making dimensions of the supply cassette 40 in the up-and-down direction large, it is possible to easily enlarge the accommodation area SP of the paper sheet P and the installation area SL of the liquid accommodation portion 30 in the supply cassette 40 while keeping a state where the accommodation area SP and the installation area SL do not interrupt each other.

In the above-described embodiment, the printer main body 12 includes a first case having the liquid ejecting head 16 and a second case which is attachable to and detachable from the first case. The supply cassette 40 in which the liquid accommodation portion 30 is installed may be provided to be insertable into and extractable from at least one of the first case and the second case. The modification example will be described with reference to the drawing.

Figure 10:
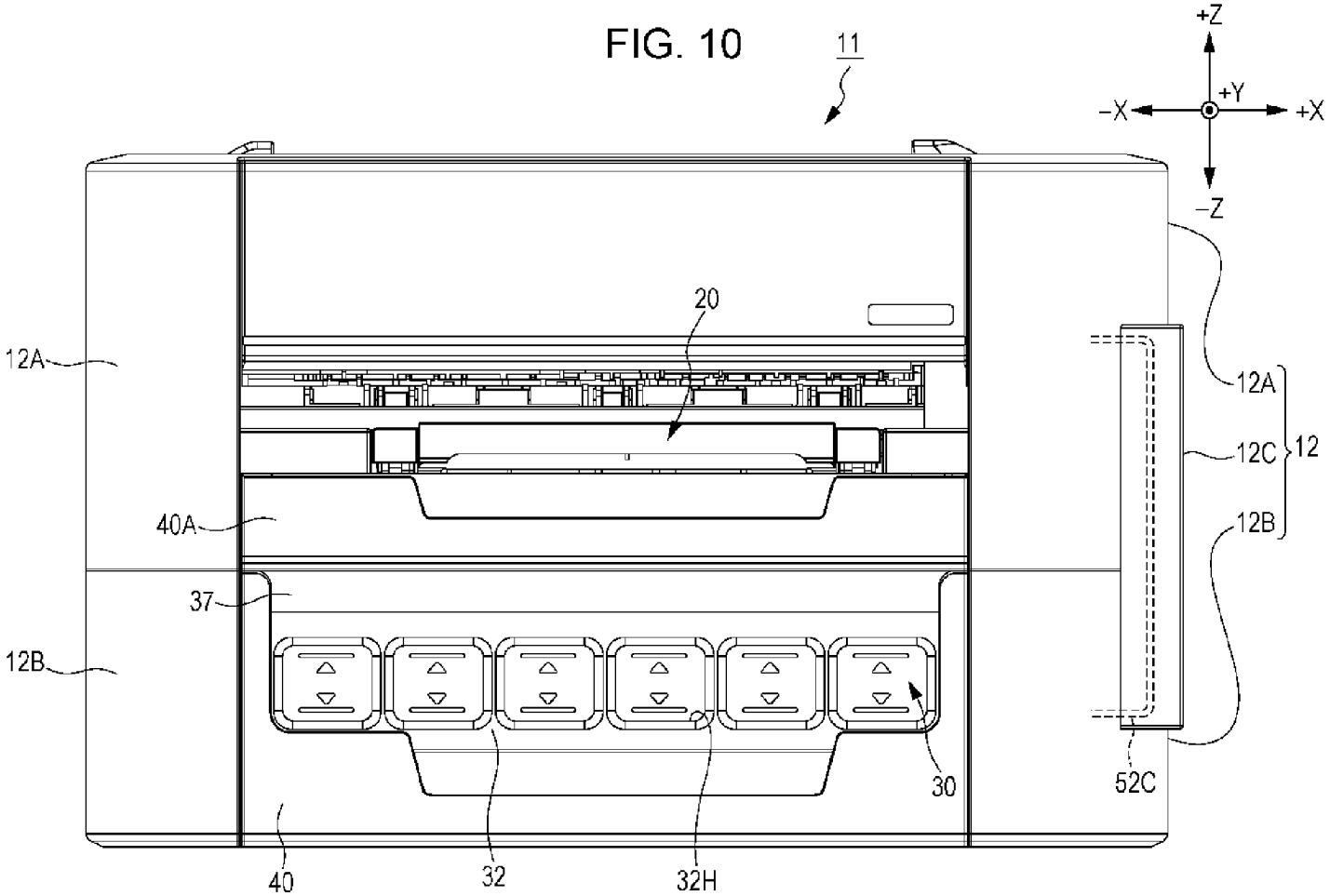
FIG. 10 is a front view illustrating the printer in which the number of the supply cassette provided with the liquid accommodation portion is increased.

As illustrated in FIG. 10, in the embodiment, the lower side case 12B which functions as the second case is provided to be attachable to and detachable from the upper side case 12A which functions as the first case. A supply cassette 40A which can accommodate the paper sheet P is provided to be insertable into and extractable from the upper side case 12A, right below the discharging portion 20, in the upper side case 12A. Therefore, the printer 11 can perform the printing operation on the paper sheet P even without mounting the lower side case 12B, and the lower side case 12B functions as a so-called extension unit which is mounted as necessary.

In the modification example, for example, as a length, that is, a thickness of the lower side case 12B in the up-and-down direction increases, it is possible to provide the liquid accommodation portion 30 which has a relatively large accommodation capacity of the ink in the supply cassette 40. As the lower side case 12B which is provided with the liquid accommodation portion 30 having a large accommodation capacity of the ink is mounted to upper side case 12A as the extension unit, it is possible to supply a relatively large amount of the ink to the liquid ejecting head 16. Otherwise, in the lower side case 12B, the liquid accommodation portions 30 which have different types (for example, colors, solute materials, or the like) of ink can be provided in the supply cassette 40.

In addition, since the liquid accommodation portion 30 is disposed in the lower side case 12B which functions as the extension unit, the curved flow path portion 52C of the liquid supply tube 50 is arranged facing the upper side case 12A from the lower side case 12B as illustrated by a dotted line in FIG. 10. For this reason, the lid case 12C which covers the curved flow path portion 52C is also provided in a state of being positioned across the upper side case 12A and the lower side case 12B which functions as the extension unit.

In addition, in the modification example, with respect to the lower side case 12B, another case (not illustrated) on the lower side thereof may be further provided to be attachable and detachable as the extension unit. In this case, the upper side case 12A and the lower side case 12B function as the first case, and another case which is mounted on the lower side of the lower side case 12B functions as the second case. In addition, when a plurality of extension units is overlapped on the lower side of the printer main body 12 and is mounted in a state of being a so-called multi-stage unit, in each extension unit, it is preferable that the supply path KK be provided for feeding the paper sheet P supplied from the supply cassette 40 provided in the extension unit of the lower side to the liquid ejecting head 16. In addition, it is preferable that the supply cassette 40 be provided to be insertable into and extractable from at least one of the plurality of extension units which functions as the second case.

According to the modification example, in addition to the effects (1) to (8) of the above-described embodiment, the following effect will be achieved.

(13) When the printer 11 is configured in a plurality of cases which are attachable to and detachable from each other, it is possible to provide the supply cassette 40 in which the liquid accommodation portion 30 is installed in any of the cases. For example, when a supply cassette is provided in the second case which is attachable to and detachable from the first case, with respect to the liquid ejecting head having the first case, according to the mounted second case, it is possible to provide a liquid accommodation portion which can supply various amounts of liquid and various types of liquid.

In the above-described embodiment, the liquid accommodation portion 30 may be provided with the liquid accommodation body 31 which has a structure other than the ink tank that is formed of a material having rigidity. For example, as the liquid accommodation body 31, an ink bag 39, which can accommodate the ink in a bag portion (bag) formed of a sheet member having flexibility with low rigidity, may be employed. The modification example will be described with reference to the drawing.

Figure 11:
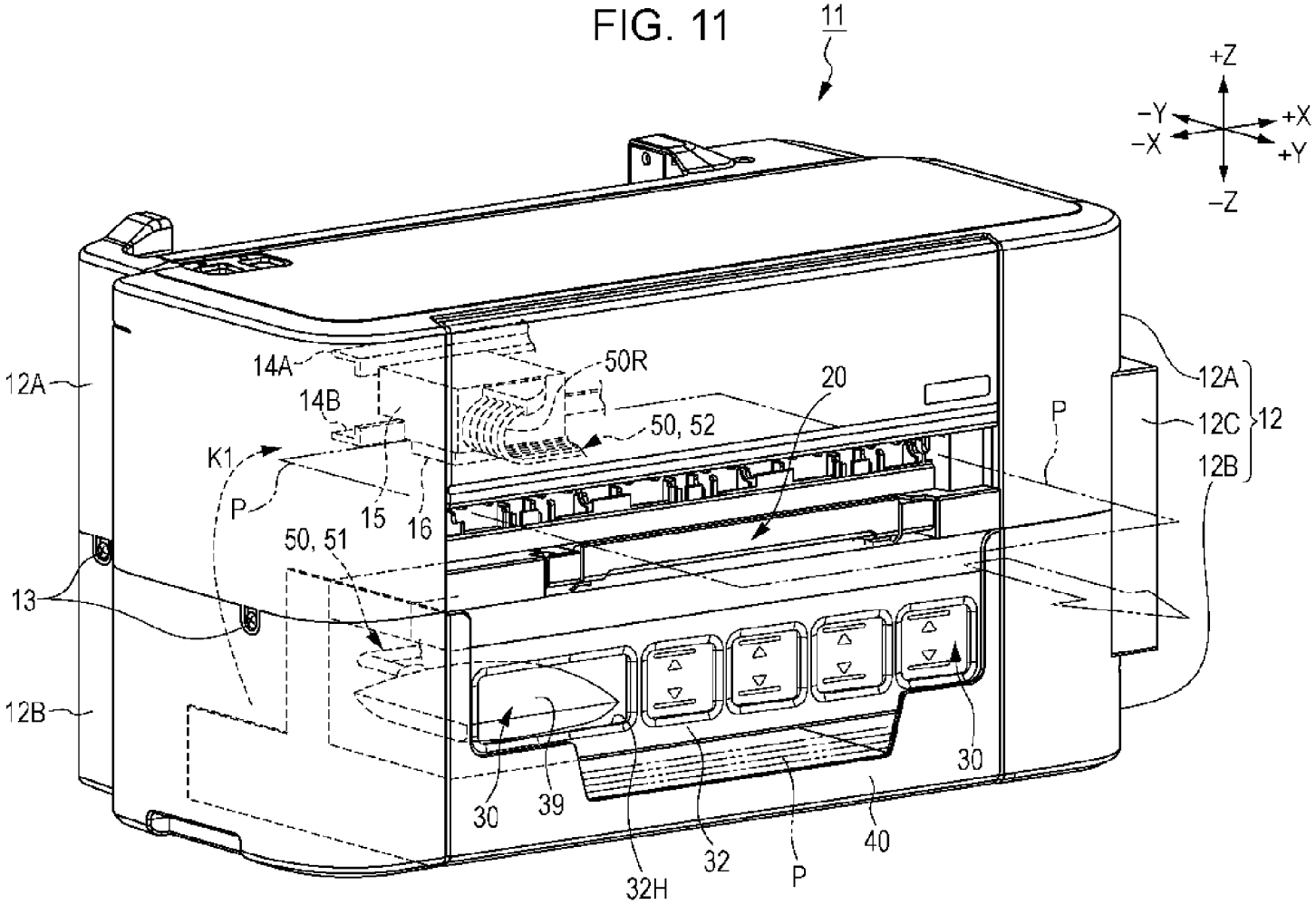
FIG. 11 is a perspective view illustrating the printer which is provided with an ink bag in the liquid accommodation portion.

As illustrated in FIG. 11, in the modification example, instead of the two liquid accommodation bodies 31 which are positioned in the left direction (−X direction) when viewed from the front surface side in the above-described embodiment, a configuration in which one ink bag 39 is provided is described. In other words, in the modification example, the liquid accommodation portion 30 supplies the ink to the liquid ejecting head 16 from one ink bag 39 and four liquid accommodation bodies 31. Originally, a configuration in which all of the liquid accommodation bodies 31 are replaced with the ink bag 39, may be employed.

As in the modification example, in the liquid accommodation portion 30, when the liquid accommodation body 31 is configured by the ink bag 39, it is possible to visually confirm a shape of the bag portion of the ink bag 39 via the through hole 32H in a substantially rectangular shape which is provided on the front side surface of the storage portion 32. In other words, as the shape change of the bag portion which changes to be crushed is visually confirmed, it is possible to visually confirm a decrease condition of the ink accommodated in the ink bag 39. Therefore, in the modification example, the through hole 32H in a substantially rectangular shape functions as the liquid amount visual confirmation portion 33.

In addition, in the embodiment, in the ink bag 39 for which it is visually confirmed that the ink runs out, an operation of making the ink bag 39 filled with the ink is performed. When a pouring port which can fill the ink bag 39 with the ink is provided, similarly to the above-described embodiment, the ink is poured into the bag portion from the pouring port. Otherwise, when the pouring port which can pour the ink into the ink bag 39 is provided, after disconnecting the liquid supply tube 50 and exchanging the ink bag 39 with another ink bag 39 which is filled with the ink, the liquid supply tube 50 (upstream side tube 51) is connected again. Originally, when the operations are performed, it is preferable that the operator draw out the liquid accommodation portion 30 (ink bag 39) to the front surface side from the printer main body 12.

In the above-described embodiment, the liquid supply tube 50 may not necessarily be connected to the end portion of the opposite direction side to the extracting direction (+Y direction) of the supply cassette 40 with respect to the liquid accommodation portion 30. For example, one end 51*a* of the liquid supply tube 50 may be connected to a gravity direction (−Z direction) side with respect to the liquid accommodation portion 30. Otherwise, for example, when the liquid accommodation portion 30 is formed of one liquid accommodation body 31, one end 51*a* of the liquid supply tube 50 may be connected to the right direction (+X direction) side with respect to the liquid accommodation portion 30.

In the above-described embodiment, the liquid accommodation portion 30 may not necessarily be provided with the pouring port 35 which can pour the ink. For example, when the liquid accommodation portion 30 is configured by the ink bag 39 as in the above-described modification example, without pouring the ink into the bag portion, the ink bag 39 in which the ink runs out will be exchanged with a new ink bag 39 in a state of being filled with the ink. Therefore, in this case, the liquid accommodation portion 30 is not required to have the pouring port 35 of the ink.

In the above-described embodiment, the supply cassette 40 may not necessarily be inserted into the printer main body 12 in a state where the ink is accommodated in the liquid accommodation portion 30 and the paper sheet P is accommodated. For example, when the paper sheet P is provided to the liquid ejecting head 16 from other than the supply cassette 40 in the printer 11, the supply cassette 40 may be inserted into the printer main body 12 in a state where the paper sheet P is not accommodated and the ink is accommodated in the liquid accommodation portion 30.

In the above-described embodiment, the liquid accommodation portion 30 may not necessarily be provided on the extracting direction (+Y direction) side from the printer main body 12 in the supply cassette 40. For example, the liquid accommodation portion 30 may be provided on the opposite direction (−Y direction) side to the extracting direction in the supply cassette 40. In other words, if the liquid accommodation portion 30 is positioned in the supply cassette 40, an increase in the installation area of the printer 11 is suppressed. Originally, in this case, it is preferable that the liquid accommodation portion 30 can move up to an allowable position where the first cover member 37 can move to the outside of the printer main body 12 by the slide mechanism.

In the above-described embodiment, the liquid accommodation portion 30 may not necessarily be configured to move by the movement of the storage portion 32 which moves by the slide mechanism. For example, a configuration in which a moving mechanism is provided in the liquid accommodation portion 30 and the liquid accommodation portion 30 directly moves not via the storage portion 32, may be employed. In this case, it is not necessarily required that the storage portion 32 of the liquid accommodation portion 30 in the supply cassette 40 be provided.

In the above-described embodiment, in the supply cassette 40, the moving mechanism which can move the liquid accommodation portion 30 is not necessarily provided. For example, although not illustrated in the drawings, according to the extraction of the supply cassette 40, when the pouring port 35 of the ink to the liquid accommodation portion 30 can move to the outside of the printer main body 12, it is not required that the liquid accommodation portion 30 in the supply cassette 40 be moved.

In the above-described embodiment, the liquid accommodation portion 30 may not necessarily be provided with the liquid amount visual confirmation portion 33 which can visually confirm the amount of the ink accommodated in the liquid accommodation portion 30. For example, an ink consumption amount which is ejected from the liquid ejecting head 16 in the printer 11 can be estimated. By using the estimated ink consumption amount, in a case of a configuration in which the residual amount of the ink in the liquid accommodation portion 30 can be notified to the user, the liquid amount visual confirmation portion 33 is not required.

In the above-described embodiment, the pouring port 35 may not necessarily be provided to be displaceable with respect to the printer main body 12. For example, even without displacing the pouring port 35, if the ink is poured from the pouring port 35, the pouring port 35 is not required to be displaced.

The liquid ejecting head 16 is not limited to a so-called serial head type which ejects the ink by reciprocating together with the carriage 15 in a direction which intersects with the transporting direction of the paper sheet P. In other words, in a state where a length size makes the entire shape corresponding to a width size of the paper sheet P, and a longitudinal direction thereof is fixed and disposed along a width direction which intersects with the transporting direction of the paper sheet P, a so-called line belt type which ejects the liquid toward a medium from plural nozzles provided across substantially the entire body of the longitudinal direction may be employed.

In the above-described embodiment, the printer 11 may be a recording apparatus which ejects or dispenses another type of liquid other than the ink. In addition, as a state of the liquid which is dispensed to be an extremely small amount of liquid droplets from the recording apparatus, the liquid may include the liquid which leaves traces in a granular shape, a tear shape, or a thread shape. In addition, the liquid described here may be made of a material which can be ejected from the recording apparatus. For example, the liquid may be a material in a state when a material is a liquid phase, and may include a fluid body, such as a liquid body having high or low viscosity, sol, gel water, other inorganic solvents, an organic solvent, a solution, a liquid resin, a liquid metal (metal melt), or the like. In addition, not being limited to the liquid as an example of the material, a material in which particles of a functional material made of a solid body, such as a pigment or metal particles, are dissolved in a solvent, dispersed, or mixed, may be included. Representative examples of the liquid include the ink which is described in the above-described embodiment, a liquid crystal, or the like. Here, the ink includes general water-based ink, oil-based ink, and various types of liquid composition, such as gel ink, hot melt ink, or the like. Specific examples of the recording apparatus include a recording apparatus which ejects the liquid including materials, such as an electrode material or a color material in a form of dispersion or solution, which is used in manufacturing or the like a liquid crystal display, an electroluminescence (EL) display, a surface light-emitting display, and a color filter. In addition, a recording apparatus which ejects a bio-organic material which is used in manufacturing a bio chip, a recording apparatus which ejects the liquid that is a specimen used as a precision pipette, a printing apparatus, or a micro-dispenser may be included. Furthermore, a recording apparatus which ejects a lubricating oil at a pinpoint to a precision machine, such as a timepiece or a camera, or a recording apparatus which ejects transparent resin liquid, such as a UV curing resin, onto a substrate for forming an extremely small semispherical lens (optical lens) that is used in an optical communication element or the like, may be included. In addition, a recording apparatus which ejects etching liquid, such as acid or alkali, for etching the substrate or the like, may be included.

The entire disclosure of Japanese Patent Application No. 2013-236601, filed Nov. 15, 2013 is expressly incorporated by reference herein

What is claimed is:

1. A recording apparatus, comprising:

an apparatus main body which has a liquid ejecting head that ejects liquid to a target and performs recording;

a supply cassette which is insertable into and extractable from the apparatus main body and can accommodate the target; and a liquid accommodation portion which can accommodate the liquid that is supplied to the liquid ejecting head, wherein the liquid accommodation portion is installed in the supply cassette, wherein the apparatus main body includes a first case which has the liquid ejecting head and a second case which is attachable to and detachable from the first case, and wherein the supply cassette which has the liquid accommodation portion installed thereon can be inserted into and extracted from at least one of the first case and the second case.

2. The recording apparatus according to claim 1, wherein the supply cassette is provided with a partitioning member which partitions an accommodation area for accommodating the target in a stacked state and an installation area of the liquid accommodation portion.

3. The recording apparatus according to claim 2, wherein the partitioning member partitions the accommodation area and the installation area so that the accommodation area and the installation area are not overlapped with each other when viewed from a stacking direction of the target.

4. The recording apparatus according to claim 2, wherein the partitioning member partitions the accommodation area and the installation area so that at least parts of the accommodation area and the installation area are overlapped with each other when viewed from the stacking direction of the target, and wherein, in a state where the supply cassette is inserted into the apparatus main body, the liquid accommodation portion which is installed in the supply cassette is positioned to be closer to an anti-gravity direction side in the stacking direction than the target which is accommodated in the supply cassette.

5. The recording apparatus according to claim 2, wherein the partitioning member partitions the accommodation area and the installation area so that at least parts of the accommodation area and the installation area are overlapped with each other when viewed from the stacking direction of the target, and wherein, in a state where the supply cassette is inserted into the apparatus main body, the liquid accommodation portion which is installed in the supply cassette is positioned to be closer to a gravity direction side in the stacking direction than the target which is accommodated in the supply cassette.

6. The recording apparatus according to claim 2, wherein the partitioning member is provided to be movable in the supply cassette.

7. The recording apparatus according to claim 2, wherein, in the installation area, a storage portion which stores the liquid accommodation portion is provided, and the storage portion is provided to be movable in the supply cassette.

8. The recording apparatus according to claim 1, wherein the liquid accommodation portion is installed on an extracting direction side from the apparatus main body in the supply cassette.

9. The recording apparatus according to claim 1, wherein the liquid accommodation portion is provided with a pouring port which can pour the liquid accommodated in the liquid accommodation portion.

10. The recording apparatus according to claim 1, wherein, in the apparatus main body, a liquid supply tube is provided which is connected to the liquid accommodation portion and supplies the liquid to the liquid ejecting head, and wherein the liquid supply tube is connected to an end portion on a side in a direction opposite to the extracting direction of the supply cassette in the liquid accommodation portion.

11. A recording apparatus, comprising:

an apparatus main body which has a liquid ejecting head that ejects liquid to a target and performs recording;

a supply cassette which is insertable into and extractable from the apparatus main body and can accommodate the target; and a liquid accommodation portion which can accommodate the liquid that is supplied to the liquid ejecting head, wherein the liquid accommodation portion is installed in the supply cassette, wherein the supply cassette is provided with a partitioning member which partitions an accommodation area for accommodating the target in a stacked state and an installation area of the liquid accommodation portion, wherein the partitioning member is provided to be movable in the supply cassette.

12. A recording apparatus, comprising:

an apparatus main body which has a liquid ejecting head that ejects liquid to a target and performs recording;

a supply cassette which is insertable into and extractable from the apparatus main body and can accommodate the target; and a liquid accommodation portion which can accommodate the liquid that is supplied to the liquid ejecting head, wherein the liquid accommodation portion is installed in the supply cassette, wherein the supply cassette is provided with a partitioning member which partitions an accommodation area for accommodating the target in a stacked state and an installation area of the liquid accommodation portion.

13. The recording apparatus according to claim 12, wherein the partitioning member is divided an end portion area of both sides and an end portion area of the front side of the right-and-left direction of the supply cassette.

14. The recording apparatus according to claim 12, wherein the partitioning member is divided each end portion area on both sides of the right-and-left direction of the supply cassette.

15. The recording apparatus according to claim 12, wherein the partitioning member is divided an end portion area of the front side of the supply cassette.

* * * * *